US005164593A

United States Patent [19]

Chapman et al.

[11] Patent Number: 5,164,593

[45] Date of Patent: Nov. 17, 1992

[54] MASS SPECTROMETER SYSTEM INCLUDING AN ION SOURCE OPERABLE UNDER HIGH PRESSURE CONDITIONS, AND A TWO-STAGE PUMPING ARRANGEMENT

[75] Inventors: John R. Chapman; Richard T. Gallacher, both of Sale, England

[73] Assignee: Kratos Analytical Limited, Urmston, England

[21] Appl. No.: 662,468

[22] Filed: Feb. 28, 1991

[51] Int. Cl.[5] ..... H01J 49/42

[52] U.S. Cl. ..... 250/288; 250/292

[58] Field of Search ..... 250/292, 288, 288 A, 250/290, 281, 282

[56] References Cited

U.S. PATENT DOCUMENTS

| | | | |
|---|---|---|---|
| 4,321,467 | 3/1982 | Buttrill, Jr. | 250/288 |
| 4,383,171 | 5/1983 | Simba et al. | 250/282 |
| 4,948,962 | 8/1990 | Mitsui et al. | 250/288 |
| 4,963,735 | 10/1990 | Okamoto et al. | 250/288 |
| 4,963,736 | 10/1990 | Douglas et al. | 250/292 |
| 5,015,845 | 5/1991 | Allen et al. | 250/288 |
| 5,030,826 | 7/1991 | Hansen | 250/288 |

OTHER PUBLICATIONS

Rapid Communications in Mass Spectrometry vol. 4, No. 10, 1990 pp. 369-372 (Gallagher, Chapman and Mann).

Anal Chem 1985, vol. 57, pp. 675 to 679 (Whitehouse, Dreyer, Yamashita and Fenn).

Rapid Communications in Mass Spectrometry, vol. 4, No. 12, 1990 pp. 519 to 526 (Hiroka and Kudaka).

Biological Mass Spectrometry Edited by A. L. Burlingame and J. A. McCloskey, pp. 147 to 157 (Meng, McEwen, Larsen, Whitehouse and Fenn).

*Primary Examiner*—Jack I. Berman
*Assistant Examiner*—James Beyer
*Attorney, Agent, or Firm*—Leydig, Voit & Mayer

[57] ABSTRACT

A mass spectrometer system includes an ion source effective to produce ions within a viscous flow region. A pumping arrangement is effective to produce a further viscous flow region of lower pressure than the first region, ions passing through the further region into a molecular flow region. The energy of the ions is defined as they enter the molecular flow region.

10 Claims, 2 Drawing Sheets

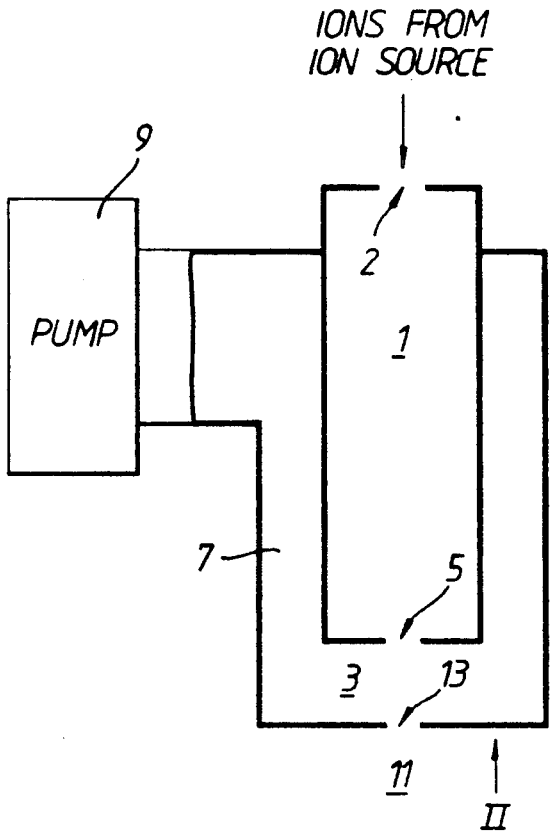
Fig.1.
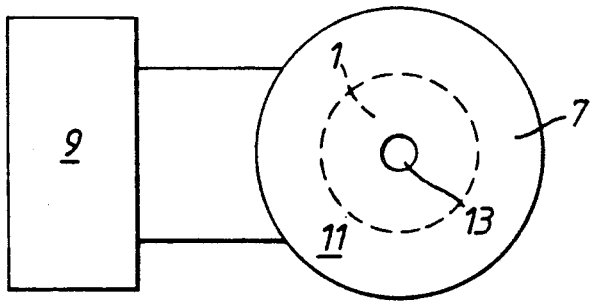
Fig.2.
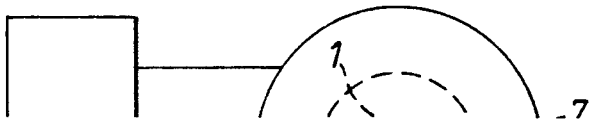

MASS SPECTROMETER SYSTEM INCLUDING AN ION SOURCE OPERABLE UNDER HIGH PRESSURE CONDITIONS, AND A TWO-STAGE PUMPING ARRANGEMENT

BACKGROUND OF THE INVENTION

1. Field of the invention

This invention relates to mass spectrometer systems. The invention has particular, although not exclusive, relevance to mass spectrometer systems which include an ion source operating under high pressure conditions, for example an electrospray ionization source.

Electrospray ionization sources produce intact ions from a complex, high molecular weight analyte in solution, by spraying the analyte in solution from a needle to which a high voltage is applied, to produce highly-charged droplets, and causing desorption of the charged analyte species from the droplets. Thus the source operates under high pressure conditions, typically close to atmospheric conditions, the ions thus originating in a viscous flow region.

The efficient coupling of any high pressure ion source, that is where ions originate in a viscous flow region, to the mass analyser of a mass spectrometer operating under high vacuum conditions, requires some form of enrichment of the ion-to-neutral gas molecule ratio in the flow which enters the mass analyser. This enrichment may be produced mechanically by use of the mass differences between the ions and neutral gas molecules. Alternatively, the enrichment may be produced electrically, by use of charging forces which preferentially direct the ions through a series of orifices leading into the high vacuum system, these orifices being very small compared with the orifices through which excess neutral gas molecules are pumped away, i.e. the technique known as "differential pumping" between regions of different degrees of vacuum.

Generally, where ions to be analysed in a mass spectrometer system originate from a viscous flow region in which the ion energy is approximately zero because of the large number of thermalising collisions by the ions with the surrounding gas molecules, it is preferred to introduce the ions directly into a region where molecular flow prevails. In the molecular flow region the only ion collisions will be with the walls of the container, and thus the energy of the ions may be precisely defined, as is necessary for mass spectrometry analysis of the ions. This introduction may be achieved by means of plates in the molecular flow region, the plates being held at an appropriate potential.

2. Description of the prior art

Where an ion source operates at a pressure close to atmospheric pressure, it is known to connnect the atmospheric pressure region directly to a molecular flow region by use of a pumping means having a very large pumping speed in the molecular flow region, and additionally or alternatively connecting the viscous flow and molecular flow regions via a very small orifice. Large pumping speeds in the molecular flow region, however, necessitate the use of large, expensive cryopumps. Use of a small orifice between the viscous flow and molecular flow regions, on the other hand, reduces ion transmission into the mass analyser, and thus reduces the sensitivity of the mass spectrometer system.

Examples of mass spectrometer systems in which a small orifice separates the viscous flow and molecular flow regions are described in articles in "Electrospray Interface for Liquid Chromatographs and Mass Spectrometers" Anal. Chem. 1985, Volume 57, pages 675–679, and "Electrospray Interface for Liquid Chromatography/Mass Spectrometry", Rapid Communications in Mass Spectrometry Volume 4, No. 12, pages 519–526, 1990. In both cases the sensitivities of the systems are reduced by the necessity of using small orifices to separate the viscous flow and molecular flow regions.

A further article "Electrospray on a Magnetic Sector Instrument", Biological Mass Spectrometry, (Edited Burlingame and McCloskey), pages 147–157, describes a mass spectrometer system including a magnetic sector analyser and an ion spray source, in which lower sensitivity was encountered than with a quadrupole instrument operating with a similar source. This was attributed to the higher pressures used in the spectrometer system which may indicate the absence of a true molecular flow region.

An article in "Electrospray Ionization on a High-Performance Magnetic-sector Mass Spectrometer", Rapid Communications in Mass Spectrometry, Volume 4, No. 5, pages 147–150, 1990, describes a system in which the viscous and molecular flow regions are separated by an intermediate pressure region. The system described has low sensitivity, highly charged ions not being detected, this being attributable to a lack of a clearly defined transition from viscous to molecular flow, with the molecular flow region being too long.

SUMMARY OF THE INVENTION

It is an object of the present invention to provide a mass spectrometry system including an ion source which operates in a high pressure region, wherein the disadvantages present in the prior art systems are at least alleviated.

According to the present invention, there is provided a mass spectrometry system comprising:

a first viscous flow region;

an ion source effective to operate at a first pressure to produce ions within said first viscous flow region;

a second viscous flow region communicating with said first viscous flow region so as to constitute a first ion path for said ions through said second viscous flow region;

first pumping means for pumping said second viscous flow region to a pressure less than said first pressure;

a molecular flow region communicating with said second viscous flow region so as to constitute a second ion path for said ions through said molecular flow region; and second pumping means for pumping said molecular flow region to a pressure less than said second pressure.

In such a mass spectrometer system, said molecular flow region may comprise a first molecular flow region, and a second molecular flow region communicating with said first molecular flow region; said second pumping means comprising a first molecular flow pumping means effective to pump said first molecular flow region to a third pressure less than said second pressure, and a second molecular flow pumping means being effective to pump said second molecular flow region to a fourth pressure less than said third pressure.

The first molecular flow pumping means suitably comprises a pump connected to said molecular flow region by a duct means defining an annular orifice which substantially surrounds said second viscous flow region.

BRIEF DESCRIPTION OF THE DRAWINGS

FIG. 1 is a schematic diagram of part of a preferred embodiment of a mass spectrometer system in accordance with the invention;

FIG. 2 is an end view of the part of the system of FIG. 1; and

DESCRIPTION OF THE PREFERRED EMBODIMENT

Figure 3:
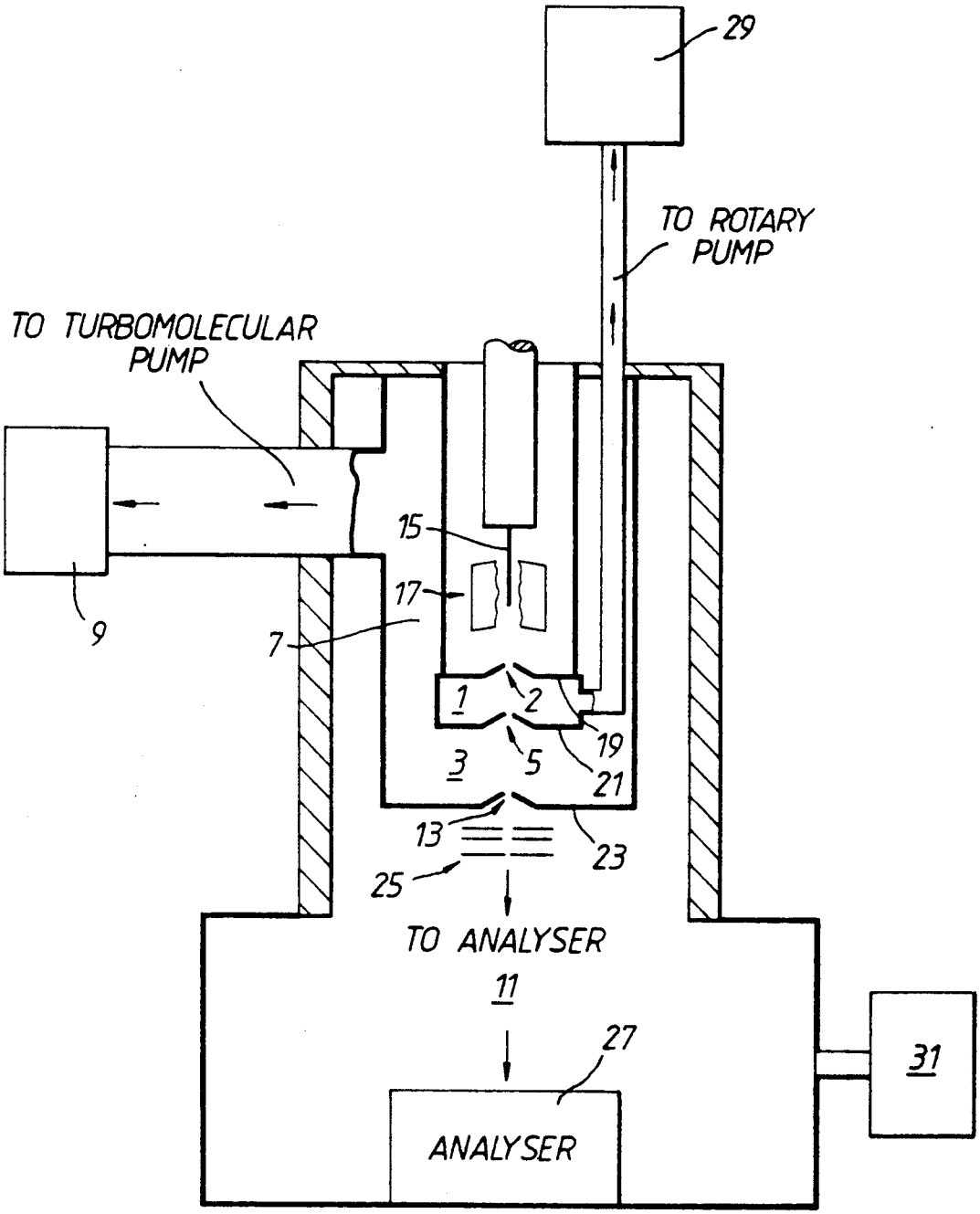
FIG. 3 is a more detailed schematic diagram of the embodiment of FIG. 1 showing further components of the mass spectrometer system.

Referring to the drawings, the preferred embodiment of a mass spectrometer system in accordance with the invention to be described, is described by way of example only, and should not be construed as limiting the scope of the invention claimed.

Referring firstly to FIGS. 1 and 2, in the embodiment of the mass spectrometer system to be described, a source (not shown) is arranged to produce a flow of ions at close to atmospheric pressure into a region 1 of viscous flow via an entrance aperture 2. The region 1 is provided with a pumping means (not shown in FIGS. 1 and 2) by which the region 1 is maintained at a relatively low pressure while still maintaining viscous flow conditions.

Typically the entrance aperture 2 will have a diameter of 0.25 mm, the pressure within the region 1 being maintained at between 10–20 Torr. The size of the entrance aperture 2 is chosen to allow effective transfer of ions at close to atmospheric pressure into the region 1, and to provide a flow rate of neutral gas molecules, which in conjunction with the pumping action of the pump 9, maintains viscous flow conditions within the region 1.

The viscous flow region 1 is connected to a further region 3 via an orifice 5. The region 3 is, in turn, connected via an annular cylindrical duct 7 to a high-speed pump 9, this conveniently being a turbomolecular pump, a diffusion pump or a very large rotary pump. The region 3 is designed to be as short as possible so as to minimize the length over which collisions of the ions emitted by the source may occur with any neutral gas molecules remaining in the region 3. The annular duct 7 provides high conductance, and therefore does not greatly reduce the effective speed of the pump 9, whilst still allowing a compact construction of the region 3. The pressure in the region 3 is typically maintained at $10^{-3}$ Torr or less, so as to produce an essentially molecular flow region.

The region 3 is connected to a further region 11 via an orifice 13 of a suitable size, the region 11 being connected to the mass analyser (not shown in FIGS. 1 and 2) for the system. The region 11 is pumped by a high-speed pump (not shown in FIGS. 1 and 2), for example a turbo-molecular or diffusion pump. As background gas molecules will have almost been completely removed within this region 11, the region 11 may be longer than the first molecular flow region 3 and thus may, for example, be constituted by the source housing region of a conventional mass spectrometer which has not been designed to operate with high pressure ion sources.

The region 11 will typically be pumped to a pressure of $2\times10^{-6}$ Torr, so as to achieve a pressure of less than $10^{-7}$ Torr in the analyser.

Ion-to-neutral gas molecule enhancement can occur in the viscous flow region 1 by, for example, using the difference in momentum of the ions and the much lighter gas molecules to separate the ions and gas molecules. Alternatively, ion-to-neutral enhancement can occur in the molecular region flow 3 by ion optical confinement or focussing of the ions as the gas molecules expand out.

An alternative system configuration, is to replace the high speed pump 9 by a pump having a very high pumping speed, for example, a cryopump, so as to result in a pressure within the region 3 of well below $10^{-3}$ Torr. In such a case the further molecular flow region 11 may be omitted.

FIG. 3 shows more details of the mass spectrometer system of FIGS. 1 and 2, corresponding features to those of FIGS. 1 and 2 being correspondingly labelled. The system includes an electrospray ion source comprising a hyperdermic needle 15, surrounded by an ion focusing system 17, the needle 15 being aligned with an aperture 2 in an end plate 19. The aperture 2 in the end plate 19 is aligned with further apertures 5, 13 (in) respectively, an intermediate plate 21 and a skimmer plate 23, a standard source ion-optical system 25 being arranged between the skimmer plate 23 and the analyser 27 of the mass spectrometer system. The analyser 27 will be of a form known to those skilled in the art of mass spectrometer systems, for example, a double-focussing magnetic sector analyser with beam-defining slits.

The region 1 between the end plate 19 and the intermediate plate 21 is pumped by means of a rotary pump 29.

The region 3 between the intermediate plate 21 and skimmer plate 23 is pumped by means of a turbomolecular pump 9, which communicates with the region 3 by means of the cylindrical annular duct 7.

In use of the system illustrated in FIG. 3, a high voltage is applied to the needle 15, and an analyte in solution form is introduced through the needle 15 so as to form a spray of small, highly charged droplets from the needle, these droplets being focussed by the lens cylinder 17. Thus the ion source constituted by the needle 15 operates at a pressure close to atmospheric pressure, the rotary pump 29 being effective to pump the region 1 so as to maintain a viscous flow region as described in relation to FIGS. 1 and 2.

The turbomolecular pump 9 is effective to pump the region 3 to a pressure so as to constitute a molecular flow region. The region 11 containing the ion optical system 25 is pumped by a further turbomolecular pump 31.

In the viscous flow region 1 there will be sufficient collisions of the ions produced from the droplets with the surrounding gas molecules to ensure that the kinetic energy of the ions is very low, the kinetic energy of the ions being substantially determined by the thermal motion of the surrounding neutral gas molecules. Acceleration of the ions to the kinetic energy required for analysis by the analyser 27 begins at the intermediate plate 21 which defines the transition from viscous flow to free molecular flow. By the time the ions are extracted from the free jet expansion produced by the flow from the orifice 5, the ions should not be suffering further collisions. On the other hand, the ions should be accelerated even in the free jet expansion so that the area from which they are collected remains small. In practice, the extraction voltage, defined as the voltage difference between plates 21 and 23, is chosen so that the ions are extracted as close as possible to the free jet expansion whilst minimizing the energies gained between any subsequent collisions.

It will be appreciated that whilst a system in accordance with the invention finds particular application where the ion source is an electrospray arrangement, systems in accordance with the invention will find application with other sources arranged to produce ions in a viscous flow region.

What we claim is:

1. A system for supplying ions to be analyzed comprising a first viscous flow region;

an ion source effective to operate at a first pressure to produce ions within said first viscous flow region;

a second viscous flow region communicating with said first viscous flow region so as to constitute a first ion path for said ions through said second viscous flow region;

first pumping means for pumping said second viscous flow region to a second pressure less than said first pressure;

a molecular flow region communicating with said second viscous flow region so as to constitute a second ion path for said ions through said molecular flow region, said molecular flow region being designed to minimize the length of said second ion path through the molecular flow region; and a second pumping means for pumping said molecular flow region to a pressure less than said second pressure, the system being such that ions from the ion source may pass from said molecular flow region into a mass analyser.

2. A system according to claim 1 in which said molecular flow region comprises a first molecular flow region, and a second molecular flow region communicating with said first molecular flow region; and said second pumping means comprises a first molecular flow pumping means effective to pump said first molecular flow region to a third pressure less than said second pressure, and a second molecular flow pumping means effective to pump said second molecular flow region to a fourth pressure less than said third pressure.

3. A system according to claim 2 in which said first molecular flow pumping means comprises a pump connected to said molecular flow region by a duct means defining an annular region which substantially surrounds said second viscous flow region.

4. A system according to claim 1 in which said first pressure is substantially atmospheric pressure, and said second pressure is less than 20 Torr.

5. A system according to claim 1 in which said third pressure is less than $10^{-3}$ Torr.

6. A system according to claim 2 in which said fourth pressure is less than $10^{-5}$ Torr.

7. A mass spectrometer according to claim 1 including means for applying an energy defining voltage for defining the energy of ions entering the molecular flow region after said ions have left the second viscous flow region.

8. A mass spectrometer according to claim 2 including a housing, said second molecular flow region being included in said housing.

9. A system for supplying ions to be analysed comprising:

a first viscous flow region;

an ion source effective to operate at a first pressure to produce ions within said first viscous flow region;

a second viscous flow region communicating with said first viscous flow region so as to constitute a first ion path for said ions through said second viscous flow region;

first pumping means for pumping said second viscous flow region to a pressure less than said first pressure;

a molecular flow region communicating with said second viscous flow region so as to constitute a second ion path for said ions through said molecular flow region, said molecular flow region being designed to minimize the length of said second ion path through the molecular flow region;

second pumping means for pumping said molecular flow region to a pressure less than said second pressure;

said second pumping means comprising a pump connected to said molecular flow region by a duct means defining an annular region which substantially surrounds said second viscous flow region, and means for defining the energy of ions entering the molecular flow region after said ions have left the second viscous flow region, the system being such that ions from the ion source may pass from said molecular flow region into a mass analyser.

10. A mass spectrometer system comprising:

a first viscous flow region;

an ion source effective to operate at a first pressure to produce ions within said first viscous flow region;

a second viscous flow region communicating with said first viscous flow region so as to constitute a first ion path for said ions through said second viscous flow region;

first pumping means for pumping said second viscous flow region to a second pressure less than said first pressure;

a molecular flow region communicating with said second viscous flow region so as to constitute a second ion path for said ions through said molecular flow region, said molecular flow region being designed to minimize the length of said second ion path through the molecular flow region;

second pumping means for pumping said molecular flow region to a pressure less than said second pressure; and a mass analyser, the system being such that the ions from the ion source may pass from said molecular flow region into said mass analyser.

* * * * *